United States Patent [19]

Colonna

[11] Patent Number: 4,591,227

[45] Date of Patent: May 27, 1986

[54] CHRISTMAS TREE LIGHT SET

[76] Inventor: John P. Colonna, 6100 Midnight Pass Rd., Apt. 1183, Sarasota, Fla. 34242

[21] Appl. No.: 798,710

[22] Filed: Nov. 15, 1985

Related U.S. Application Data

[63] Continuation of Ser. No. 553,835, Nov. 21, 1983, abandoned.

[51] Int. Cl.[4] ..... H01R 21/00

[52] U.S. Cl. ..... 339/157 C

[58] Field of Search ..... 339/154 R, 154 A, 156, 339/157 R, 157 C, 158, 159 R, 159 C, 220 R

[56] References Cited

U.S. PATENT DOCUMENTS

| | | | |
|---|---|---|---|
| 1,843,389 | 2/1932 | Fischer | 339/157 C |
| 1,891,341 | 12/1932 | Barocas | 339/157 C |
| 2,277,532 | 3/1942 | Smith, Jr. | 339/157 C |
| 2,354,598 | 7/1944 | Janz | 339/157 C |
| 2,465,419 | 3/1949 | Barany | 339/177 C |
| 2,474,356 | 6/1949 | Harris | 339/157 C |
| 3,009,009 | 11/1961 | Holbrook | 339/157 C |
| 3,036,206 | 5/1962 | Holbrook | 339/157 C |
| 3,551,713 | 12/1970 | White | 339/220 R |
| 3,662,319 | 5/1972 | Culver | 339/28 |

*Primary Examiner*—Gil Weidenfeld
*Assistant Examiner*—David L. Pirlot
*Attorney, Agent, or Firm*—Vaden, Eickenroht, Thompson & Jamison

[57] ABSTRACT

An electric light set for decorating and illuminating Christmas trees and the like, having a plurality of pairs of electrical connecting wires radiating from a sealed, ring-shaped conductor housing. Each of the pairs of electrical connecting wires connects a plurality of electrical light bulb sockets for receipt of the light bulbs used with the light set. The ring-shaped conductor housing can be easily fitted over the top of a Christmas tree with the pairs of electrical connecting wires radiating downward and outward such that the light bulbs decorate and illuminate the Christmas tree. With an alternate embodiment, the ring-shaped conductor housing can be attached to the surface of a window or other similar object.

12 Claims, 12 Drawing Figures

CHRISTMAS TREE LIGHT SET

This application is a continuation of application Ser. No. 553,835 filed Nov. 21, 1983 now abandoned.

BACKGROUND OF THE INVENTION

This invention relates generally to an electrical light set for decorating and illuminating Christmas trees and the like, and, more particularly, to such a light set having a plurality of pairs of electrical connecting wires radiating from a sealed, ring-shaped conductor housing.

Traditional Christmas tree light sets consist essentially of a pair of electrical connecting wires which connect a plurality of light bulb sockets in series or parallel and a plug having a pair of prongs for insertion in the openings of an electrical outlet of a house circuit. An electrical light bulb is screwed or otherwise fitted in each of the sockets. Decorated and illuminated Christmas trees are often provided with a plurality of such light sets to achieve the desired effect. Unfortunately, several electrical connectors and extension cords are generally required for the placement and use of a plurality of such light sets on a single tree. This arrangement is often costly, cumbersome and unsightly, and occasionally hazardous.

Various efforts have been made to overcome the problems associated with the placement and use of a plurality of traditional Christmas tree light sets on a single tree. For example, U.S. Pat. No. 1,843,389, issued to Fischer, for an Electrical Lighting Set for Christmas Trees or the Like, discloses a light set having a plurality of unsealed, multiple component, conductor housings each of which has a plurality of pairs of electrical connecting wires radiating outward. Each pair of wires is connected to a socket for receipt of an electrical light bulb. Unfortunately, the conductor housings disclosed in U.S. Pat. No. 1,843,389 lack the inherent safety features of a sealed conductor housing. Additionally, the light set disclosed in U.S. Pat. No. 1,843,389 is cumbersome and difficult to place on and attach to a Christmas tree. Finally, the light set disclosed in U.S. Pat. No. 1,843,389 lacks flexibility for use in decorating and illuminating objects other than Christmas trees.

Various electrical connectors for attachment to a Christmas tree are disclosed in U.S. Pat. No. 1,891,341, issued to Barocas, for an Electrical Light Attachment Set, U.S. Pat. No. 2,277,532, issued to Smith, for a Christmas Tree Lighting Outfit, and U.S. Pat. No. 2,465,419, issued to Barany, for a Circular Electrical Outlet. Each of these connectors is adapted for receipt of the prongs of a plurality of plugs to facilitate the placement and use of a plurality of Christmas tree light sets on a single tree. Unfortunately, the combination of such a connector and a plurality of light sets is more costly and cumbersome for use in decorating and illuminating a Christmas tree than a single light set having an identical number of light bulbs. Additionally, such a combination lacks flexibility for use in decorating and illuminating objects other than Christmas trees. And, of course, such a combination lacks the inherent safety features of a single light set having a sealed conductor housing.

SUMMARY OF THE INVENTION

The present invention provides an electrical light set for decorating and illuminating Christmas trees and the like. More particularly, the present invention provides such a light set having a plurality of pairs of electrical connecting wires radiating from a sealed, ring-shaped conductor housing.

The light set of the present invention comprises a sealed, ring-shaped conductor housing, a pair of electrical feed wires and a plurality of pairs of electrical connecting wires. Each of the pairs of electrical connecting wires connects a plurality of electrical light bulb sockets for receipt of the light bulbs used with the light set. The housing comprises an open topped, main body having first and second ring-shaped conductor channels in its interior and a cover plate which is permanently sealed in the open top after the wiring process is completed. Preferably, both the main body and the cover plate of the housing are formed from a plastic material which is readily fusible by an ultrasonic process.

The electrical feed wires and electrical connecting wires are permanently connected in the interior of the ring-shaped conductor housing such that the first and second conductor channels provide the necessary physical separation for proper electrical insulation purposes. The wiring arrangement which is used is dependent on the number of pairs of electrical connecting wires, the number of light bulb sockets connected by each pair of electrical connecting wires, and the voltage rating for each light bulb intended for use with the light set. The ring-shaped conductor housing can be easily fitted over the top of a Christmas tree with the pairs of electrical connecting wires radiating downward and outward such that the light bulbs decorate and illuminate the tree. Since all wire connections are permanently sealed in the interior of the housing, the light set is substantially safer than the light sets and related structures which the prior art provides for similar decorating and illuminating purposes. With an alternative, adhesive coated cover plate for the ring-shaped conductor housing, the light set can be adhesively attached to windows and other similar objects.

These and many other advantages, features and objects of the present invention will be apparent from the following brief description of the drawings, description of the preferred embodiment and claims, and the accompanying drawings.

DESCRIPTION OF THE PREFERRED EMBODIMENT

The preferred embodiment of the electrical light set of the present invention is illustrated in FIGS. 1–12.

Figure 1:
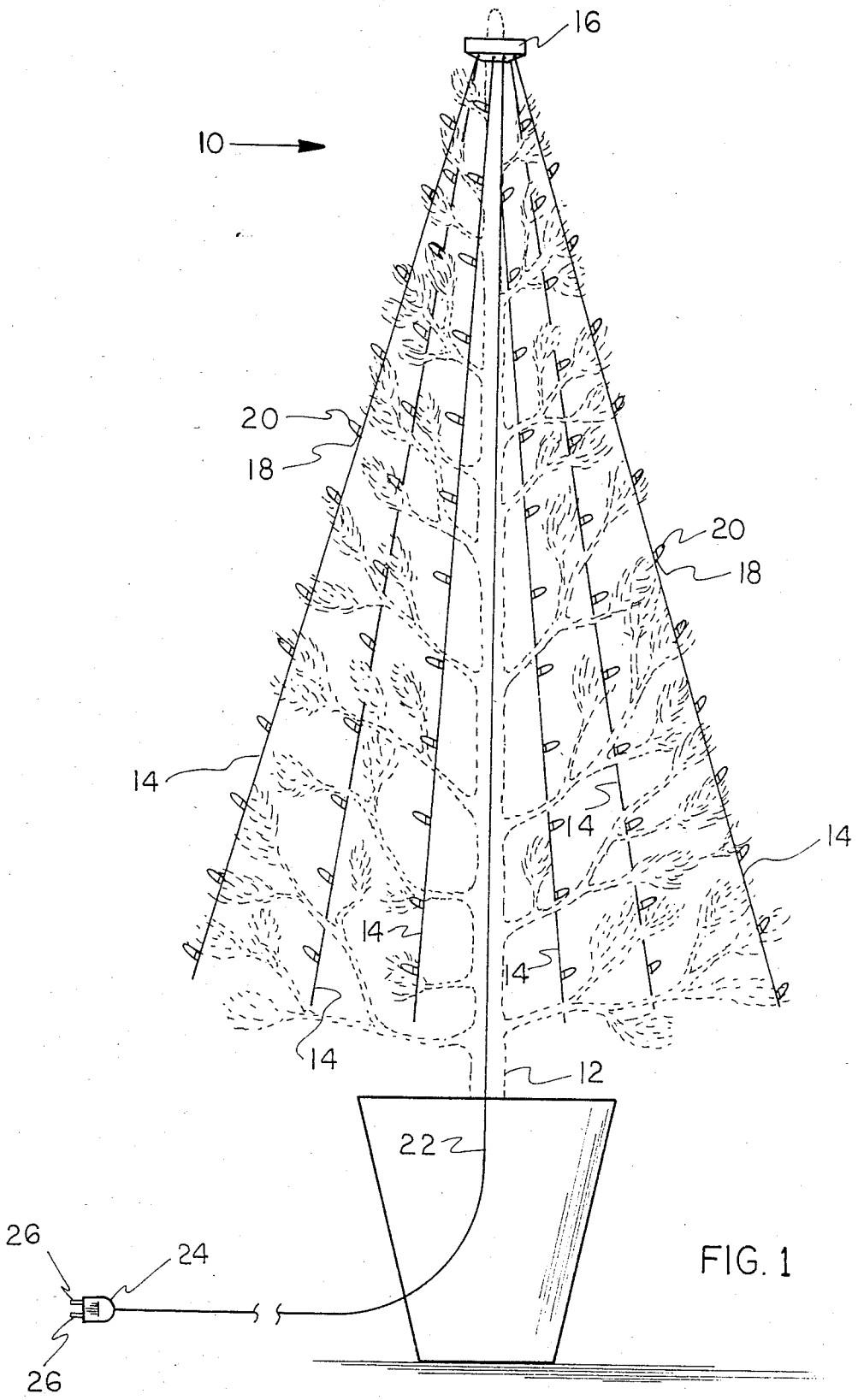
FIG. 1 is an elevational view of a Christmas tree with the electrical light set of the present invention in place.

Referring initially to FIG. 1, the electrical light set 10 which is illustrated in place on a typical Christmas tree 12 comprises six pairs of electrical connecting wires 14 radiating from a ring-shaped conductor housing 16. Each pair of wires 14 connects a plurality of light bulb sockets 18 in series. An electrical light bulb is screwed or otherwise fitted in each of the sockets 18. Each of the light bulbs 20 has a shunt wire on its base which enables the electrical current to bypass a burned out or broken filament. A pair of electrical feed wires 22 connected to a fused plug 24 having two prongs 26 for insertion in the openings of a conventional electrical outlet also radiate from the housing 16. The connecting wires 14 and feed wires 22 are covered with rubber or another suitable electrical insulating material in the conventional manner.

Figure 2:
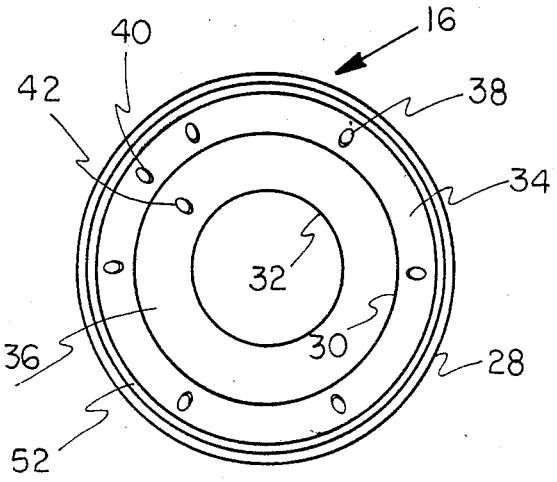
FIG. 2 is a top planar view of the ring-shaped conductor housing of the light set with its cover plate removed.
Figure 3:
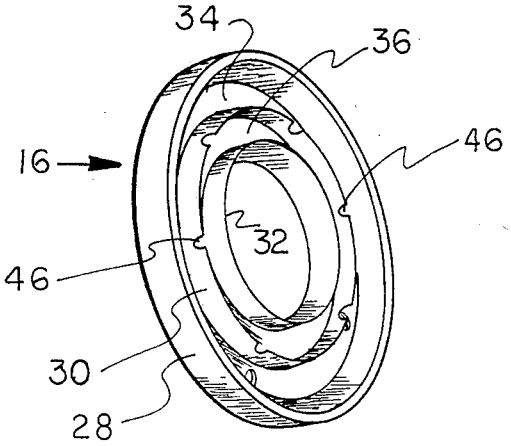
FIG. 3 is a perspective view of the ring-shaped conductor housing with its cover plate removed.
Figure 7:
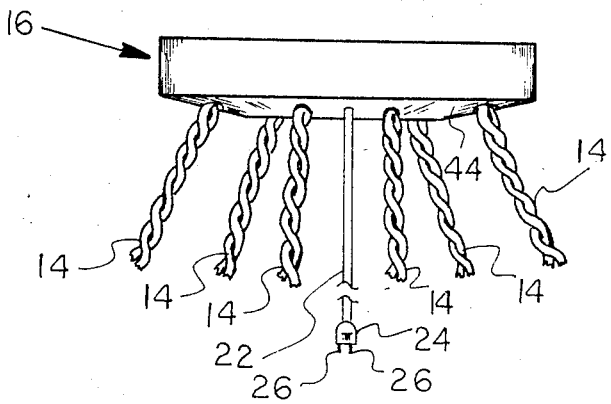
FIG. 7 is a side elevational view of the ring-shaped conductor housing with electrical conducting wires radiating from its holes.

Referring now to FIGS. 2 and 3, the open topped, main body of the ring-shaped conductor housing 16 is preferably molded from plastic, but may be formed by other processes from another suitable electrical insulating material. An outer wall 28 and a dividing wall 30 circumscribe a first conductor channel 34 in the interior of the housing 16. The dividing wall 30 and an inner wall 32 circumscribe a second conductor channel 36 in the interior of the housing 16. The first and second conductor channels 34 and 36 are ring-shaped and concentric. The base of the first conductor channel 34 is provided with six equally spaced holes 38 for receipt of the electrical connecting wires 14. A seventh hole 40 in the base of the first conductor channel 34 and an adjacent hole 42 in the base of the second conductor channel 36 are provided for receipt of the electrical feed wires 22. The holes 38, 40 and 42 are positioned at an angle which causes the wires 14 and 22 to radiate outward from the bottom 44 of the housing 16 as best illustrated in FIGS. 1 and 7. The top of the dividing wall 30 is provided with six generally circular notches 46, one adjacent to each of the holes 38, to facilitate cross over of the wires 14 and 22 from the first conductor channel 34 to the second conductor channel 36 during the wiring process.

Referring to FIGS. 6–11, the connection of the wires 14 and 22 in the interior of the ring-shaped conductor housing 16 to complete the electrical circuit of the light set 10 will now be described. First, the upper ends of the electrical connecting wires 14 are passed from the bottom 44 of the housing 16 through the holes 38 into the first conductor channel 34 such that one pair of wires 14 is positioned in each hole 38. Next, the upper end of one of the electrical lead wires 22 is passed from the bottom 44 of the housing 16 through the hole 40 into the first conductor channel 34 and the upper end of the other of the electrical lead wires 22 is passed from the bottom 44 of the housing 16 through the hole 42 into the second conductor channel 36 such that one of the wires 22 is positioned in the hole 40 and the other of the wires 22 is positioned in the hole 42. The upper end of each of the wires 14 and 22 is permanently connected to the upper end of one of the other wires 14 and 22 by a conventional solder joint 48.

Figure 8:
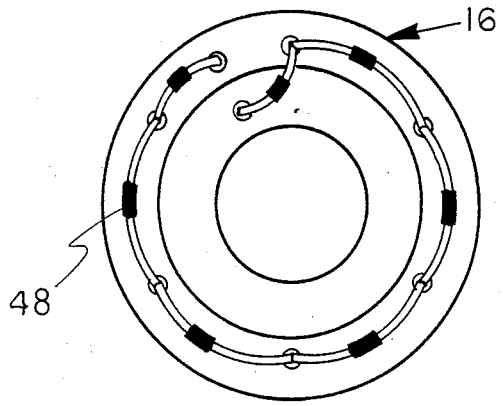
FIG. 8 is a schematic view of the interior of the ring-shaped conductor housing illustrating the wiring arrangement for six pairs of electrical connecting wires when six 3.5 volt light bulbs are connected by each pair of wires.
Figure 9:
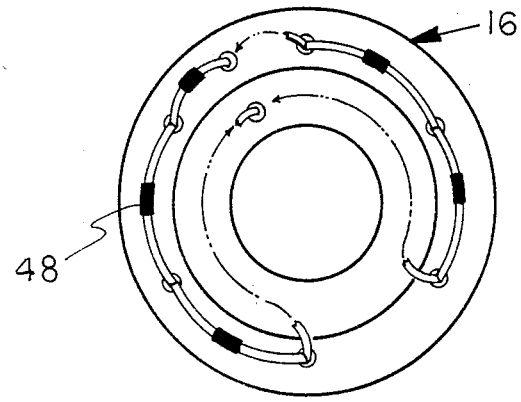
FIG. 9 is a schematic view of the interior of the ring-shaped conductor housing illustrating the wiring arrangement for six pairs of electrical connecting wires when twelve 3.5 volt light bulbs are connected by each pair of wires.
Figure 10:
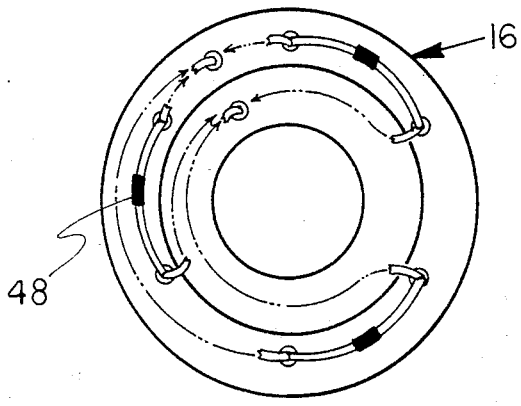
FIG. 10 is a schematic view of the interior of the ring-shaped conductor housing illustrating the wiring arrangement for six pairs of electrical connecting wires when eighteen 3.5 volt light bulbs are connected by each pair of wires.
Figure 11:
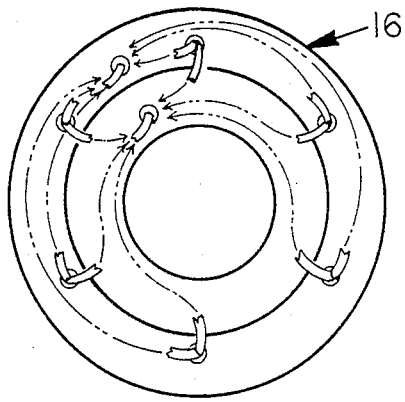
FIG. 11 is a schematic view of the interior of the ring-shaped conductor housing illustrating the wiring arrangement for six pairs of electrical connecting wires when thirty-five 3.5 volt light bulbs are connected by each pair of wires.

The wiring arrangement which is used for the light set 10 is dependent on the number of light bulb sockets 18, each containing a light bulb 20, which are connected by each of the six pairs of electrical connecting wires 14 and the voltage rating for each light bulb 20. For example, if each pair of electrical connecting wires 14 connects six sockets 18, each containing a 3.5 volt light bulb 20, all of the pairs of wires 14 are connected in series as illustrated in FIG. 8. If each pair of electrical connecting wires 14 connects twelve sockets 18, each containing a 3.5 volt light bulb 20, two groups of three of the pairs of wires 14 are connected in parallel with each of the pairs of wires 14 within each group connected in series as illustrated in FIG. 9. If each pair of electrical connecting wires 14 connects eighteen sockets 18, each containing a 3.5 volt light bulb 20, three groups of two of the pairs of wires 14 are connected in parallel with each of the pairs of wires 14 within each group connected in series as illustrated in FIG. 10. Finally, as illustrated in FIG. 11, all of the pairs of electrical connecting wires 14 are connected in parallel if each pair of wires 14 connects thirty-five sockets 18, each containing a 3.5 volt light bulb.

Figure 4:
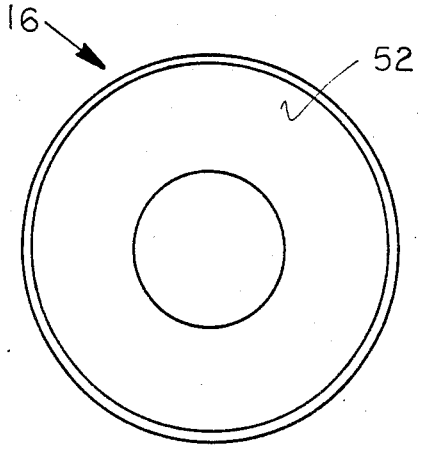
FIG. 4 is a top planar view of the ring-shaped conductor housing with its cover plate sealed in place.

After connecting the upper ends of the wires 14 and 22 in the interior of the main body of the ring-shaped conductor housing 16 in the desired wiring arrangement, a ring-shaped cover plate 50 is ultrasonically sealed or otherwise permanently sealed in the open top of the main body of the housing 16 to permanently seal the connected ends of the wires 14 and 22 in the interior of the housing 16. The ring-shaped cover plate 50 is formed from the same material as that used to form the main body of the ring-shaped conductor housing 16. As best illustrated in FIG. 2, the outer wall 28 has an indentation 52 surrounding the first conductor channel 34. This indentation 52 and the tops of the dividing wall 30 and inner wall 32 function as seats for the cover plate 50. FIG. 4 illustrates the top of the housing 16 with the cover plate 50 in place. With the preferred ultrasonic sealing process, the cover plate 50 is permanently fused to the outer wall 28, the dividing wall 30 and the inner wall 32 such that the housing 16 is effectively a one piece housing.

Figure 5:
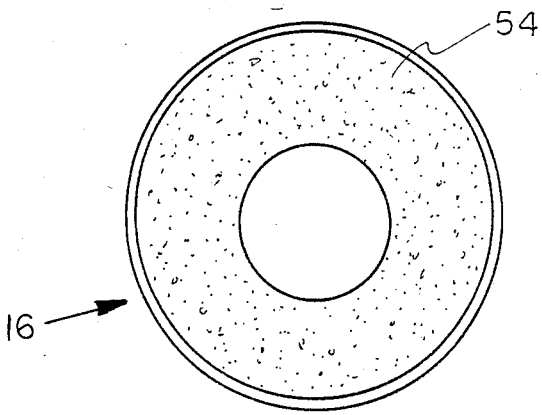
FIG. 5 is a top planar view of the ring-shaped conductor housing with an alternate, adhesive coated cover plate sealed in place.
Figure 6:
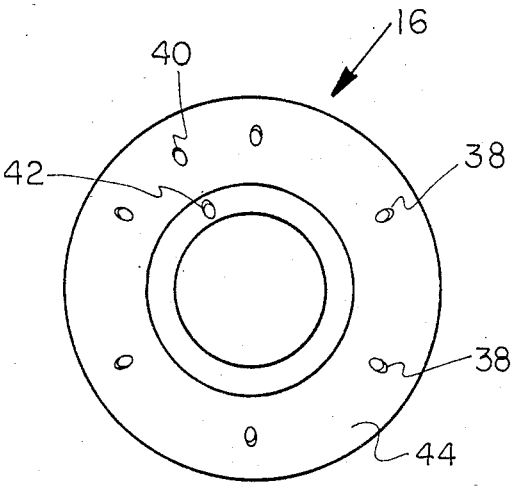
FIG. 6 is a bottom planar view of the ring-shaped conductor housing illustrating the arrangement of its holes.
Figure 12:
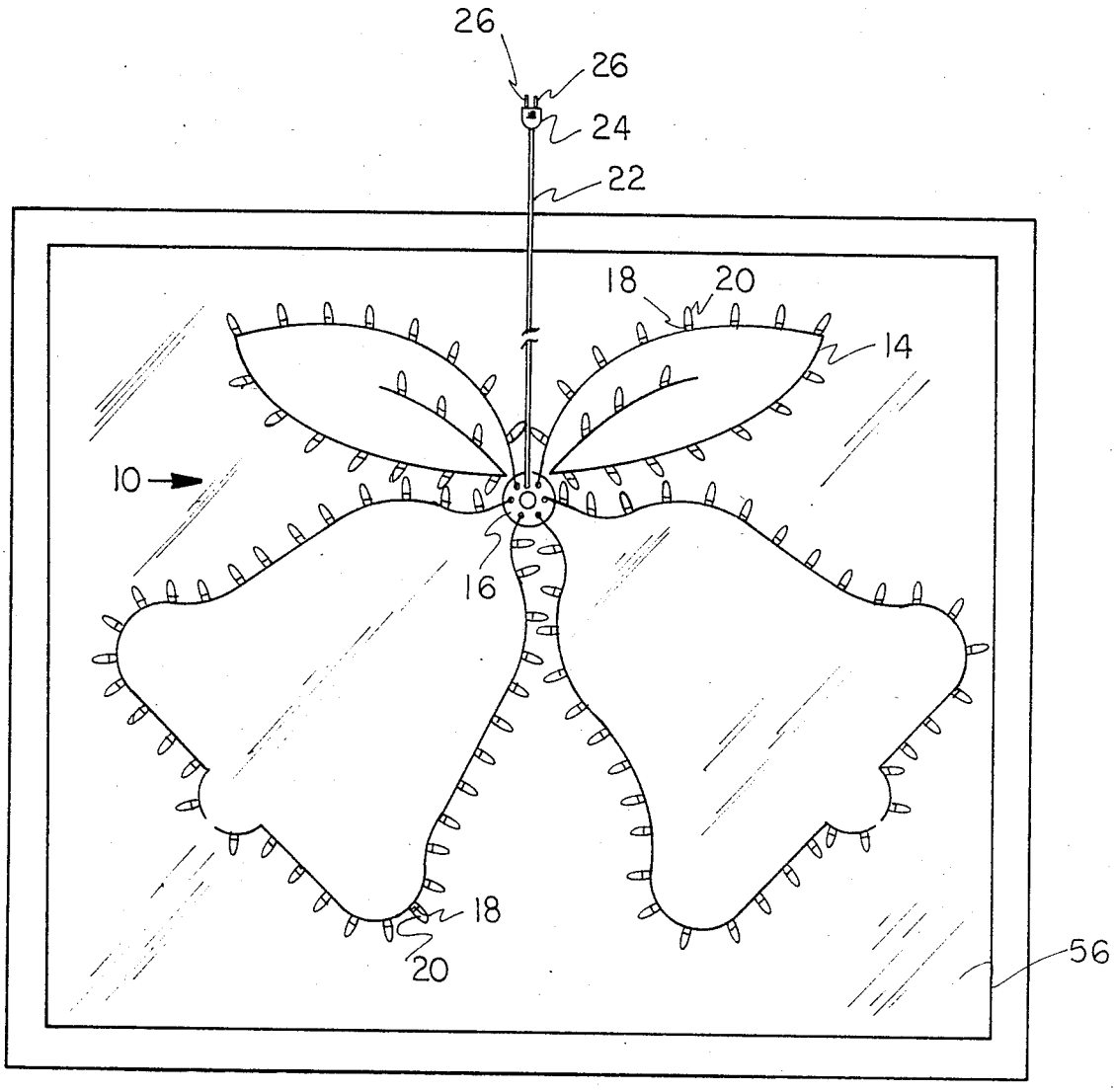
FIG. 12 is an elevational view of a window illustrating the light set in place.

The top of the ring-shaped conductor housing 16 with an alternate, adhesive coated cover plate 54 in place is illustrated in FIG. 5. If desired, the light set 10 can be provided with a separate ring-shaped disk having a suitable adhesive material on both of its sides to enable the user of the light set 10 to convert the cover plate 50 illustrated in FIG. 4 to the adhesive coated cover plate 54 illustrated in FIG. 5. One decorating and illuminating use of the light set 10 with an adhesive coated cover plate 54 for its ring-shaped conductor housing 16 is illustrated in FIG. 12 wherein the housing 16 is adhesively attached to the surface of a window 56.

While the present invention has been described and illustrated in connection with its preferred embodiment, it should be understood that there may be other embodiments which fall within the scope and spirit of the invention as defined by the following claims.

I claim:

1. An electrical light set for decorating and illuminating Christmas trees and the like, comprising:

(a) a ring-shaped conductor housing formed from an electrical insulating material, said ring-shaped conductor housing having (i) an open topped main body with an outer wall, a dividing wall and an inner wall which circumscribe a first ring-shaped conductor channel in its interior, said first ring shaped conductor channel having a plurality of holes through its base, and, concentric with said first ring-shaped conductor channel, a second ring-shaped conductor channel in its interior, said second ring-shaped conductor channel having a hole through its base, said dividing wall having a plurality of openings therethrough, and (ii) a ring-shaped cover plate formed from an electrical insulating material, said ring-shaped cover plate being permanently sealed in the open top of said open topped main body;

(b) a pair of electrical feed wires, each of said electrical feed wires having one of its ends connected to a plug having prongs for insertion in the openings of an electrical outlet, one of said electrical feed wires having the other of its ends passed through one of said holes in said base of said first ring-shaped conductor channel, and the other of said electrical feed wires having the other of its ends passed through said hole in said base of said second ring-shaped conductor channel; and (c) a plurality of pairs of electricl connecting wires, each of said pairs of electrical connecting wires being connected to a plurality of electrical light bulb sockets, and each of said pairs of electrical connecting wires having the same end of each of said electrical connecting wires in the pair passed through one of said holes in said base of said first ring-shaped conductor channel;

said electrical feed wires and said electrical connecting wires being appropriately crossed over between said first ring-shaped conductor channel and said second ring-shaped conductor channel through said openings through said dividing wall and permanently connected in the interior of said open topped main body of said ring-shaped conductor housing to create an electrical circuit which is appropriate for the number of said pairs of electrical connecting wires, the number of said light bulb sockets connected to each of said pairs of electrical connecting wires, and the voltage rating of the light bulbs intended for use in said light bulb sockets.

2. An electrical light set as recited in claim 1, wherein said ring-shaped cover plate is permanently sealed in the open top of said open topped main body by an ultrasonic sealing process.

3. An electrical light set as recited in claim 1, wherein said openings through said dividing wall for cross over of said electricl feed wires and said electrical connecting wires comprises a plurality of notches in the top of said dividing wall.

4. An electrical light set as recited in claim 1, wherein said ring-shaped cover plate has an adhesive coating on its outer surface.

5. An electrical light set as recited in claim 4, wherein said adhesive coating is a ring-shaped disk having an adhesive material on both of its sides.

6. An electrical light set as recited in claim 1, wherein the central axis of each of said holes through said base of said first ring-shaped conductor channel and the central axis of said hole through said base of said second ring-shaped conductor channel are positioned at essentially identical angles to the central axis of said ring-shaped conductor housing such that said electrical feed wires and said electrical connecting wires radiate downward and outward from the bottom of said main body of said ring-shaped conductor housing.

7. An electrical light set as recited in claim 6, wherein the tops of said outer wall, said dividing wall and said inner wall are in the same plane, said dividing wall and said inner wall are of equal height, said outer wall is of a height which is less than the height of said dividing wall and said inner wall, and said bottom of said main body of said ring-shaped conductor housing slopes downward from the bottom of said outer wall to the bottom of said dividing wall.

8. An electrical light set for decorating and illuminating Christmas trees and the like, comprising:

(a) a ring-shaped conductor housing formed from an electrical insulating material, said ring-shaped conductor housing having (i) an open topped main body with an outer wall, a dividing wall and an inner wall, said dividing wall having a plurality of notches in its top, said outer wall and said inner wall circumscribing a first ring-shaped conductor channel in its interior, said dividing wall and said inner wall circumscribing a second ring-shaped conductor channel in its interior, said first ring-shaped conductor channel and said second ring shaped conductor housing being concentric, said first ring-shaped conductor channel having a plurality of holes through its base, said second ring-shaped conductor channel having a hole through its base, said holes through said base of said first ring-shaped conductor channel and said hole through said base of said second ring-shaped conductor channel each having its central axis positioned at an essentially identical angle to its central axis, and (ii) a ring-shaped cover plate formed from an electrical insulating material, said ring-shaped cover plate being permanently sealed in the open top of said open topped main body;

(b) a pair of electrical feed wires, each of said electrical feed wires having one of its ends connected to a plug having prongs for insertion in the openings of an electric outlet, one of said electrical feed wires having the other of its ends passed through one of said holes in said base of said first ring-shaped conductor channel, and the other of said electrical feed wires having the other of its ends passed through said hole in said base of said second ring-shaped conductor channel; and (c) a plurality of pairs of electrical connecting wires, each of said pairs of electrical connecting wires being connected to a plurality of electrical light bulb sockets, and each of said pairs of electrical connecting wires having the same end of each of said electrical connecting wires in each of said electrical connecting wires in the pair passed through one of said holes in said base of said first ring-shaped conductor channel;

said electrical feed wires and said electrical connecting wires being appropriately crossed over between said first ring-shaped conductor channel and said second ring-shaped conductor channel through said notches in said dividing wall and permanently connected in the interior of said open topped main body of said ring-shaped conductor housing to create an electrical circuit which is appropriate for the number of said pairs of electrical connecting wires, the number of said light bulb sockets connected to each of said pairs of electrical connecting wires, and the voltage rating of the light bulbs intended for use in said light bulb sockets.

9. An electrical light set as recited in claim 8, wherein said ring-shaped cover plate is permanently sealed in the open top of said open topped main body by an ultrasonic sealing process.

10. An electrical light set as recited in claim 8, wherein said ring-shaped cover plate has an adhesive coating on its outer surface.

11. An electrical light set as recited in claim 10, wherein said adhesive coating is a ring-shaped disk having an adhesive material on both of its sides.

12. An electrical light set as recited in claim 11, wherein the tops of said outer wall, said dividing wall and said inner wall are in the same plane, said dividing wall and said inner wall are of equal height, said outer wall is of a height which is less than the height of said dividing wall and said inner wall, and said main body of said ring-shaped conductor housing slopes downward from the bottom of said outer wall to the bottom of said dividing wall.

* * * * *

UNITED STATES PATENT AND TRADEMARK OFFICE

CERTIFICATE OF CORRECTION

PATENT NO. : 4,591,227

DATED : May 27, 1986

INVENTOR(S) : John P. Colonna

It is certified that error appears in the above-identified patent and that said Letters Patent is hereby corrected as shown below:

Column 5, line 38, delete the word "electricl", insert --electrical--;

Column 5, line 64, delete the word "electricl", insert --electrical--;

Signed and Sealed this

Twenty-fifth Day of November, 1986

*Attest:*

DONALD J. QUIGG

*Attesting Officer* *Commissioner of Patents and Trademarks*